United States Patent [19]

Ruggieri

[11] Patent Number: 4,891,234

[45] Date of Patent: Jan. 2, 1990

[54] SPAGHETTI SIPPER

[76] Inventor: Nicholas A. Ruggieri, 5 Braddock St., Rochester, N.Y. 14612

[21] Appl. No.: 245,810

[22] Filed: Sep. 19, 1988

[51] Int. Cl.[4] ..... B65B 83/00

[52] U.S. Cl. ..... 426/115; 426/85; 426/112; 426/394; 221/251; 221/294; 225/90

[58] Field of Search ..... 426/85, 112, 115; 221/251, 294, 239, 309, 312 C; 229/103.1; 132/323, 324, 325, 326; 225/51, 52, 74, 75, 84, 85, 90

[56] References Cited

U.S. PATENT DOCUMENTS 1,955,566 4/1934 Schulz ..... 206/52

3,870,059 3/1975 Bennington ..... 132/92 A

*Primary Examiner*—Donald E. Czaja

*Assistant Examiner*—D. Workman

*Attorney, Agent, or Firm*—Robert M. Phipps

[57] ABSTRACT

A device for sipping and consuming pasta products such as spaghetti is made possible by the inclusion of a pawl on the pathway of the pasta from the container to the consumer of the pasta.

6 Claims, 1 Drawing Sheet

FIG. 1
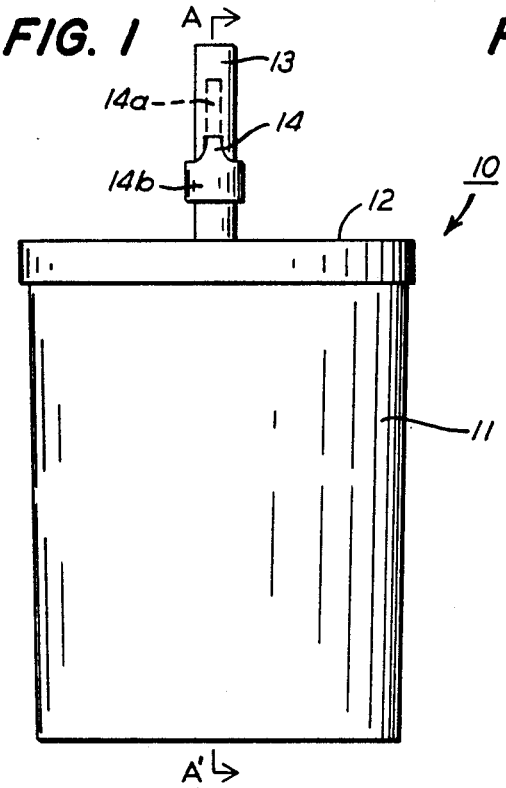
FIG. 3
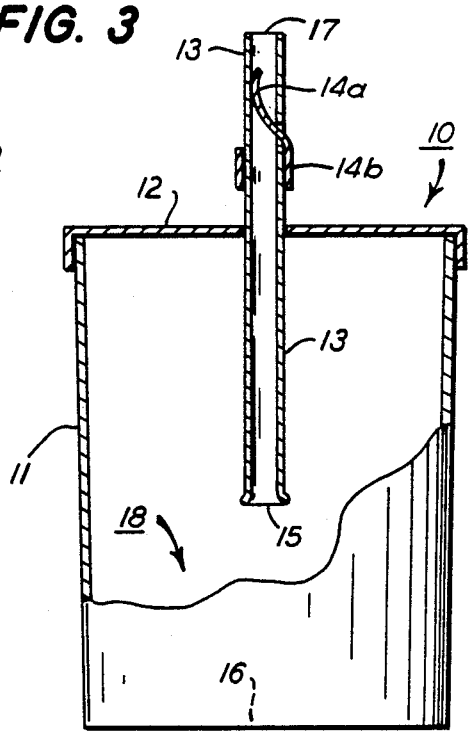
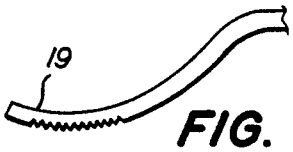
FIG. 5
FIG. 4
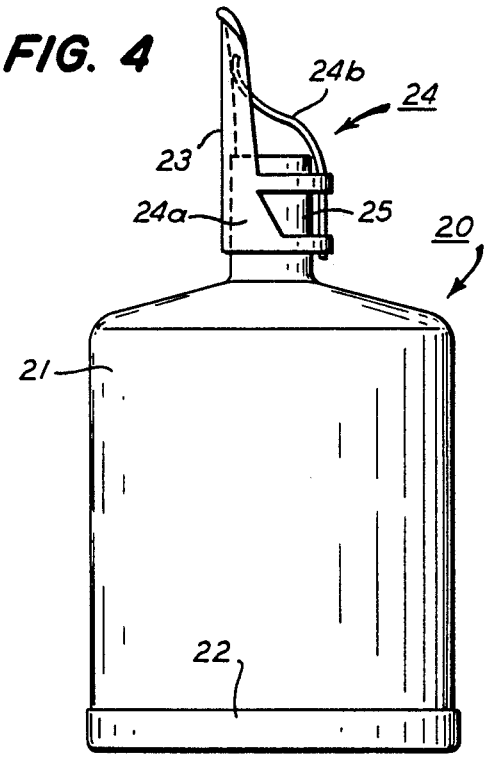
FIG. 2
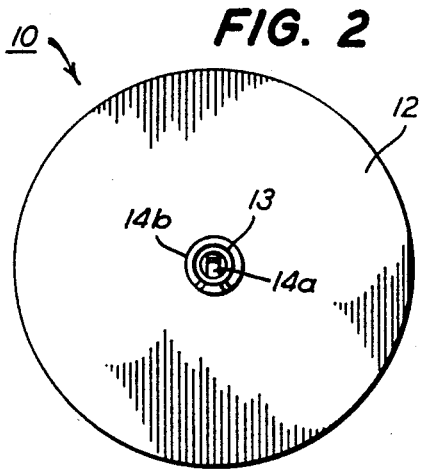

SPAGHETTI SIPPER

BACKGROUND

1. Field of the Invention

This invention relates to means for eating spaghetti and similar pasta products while walking, strolling or the like.

2. Description of the Prior Art

The general public is prone to eating while strolling. This is quickly established when watching people attending fairs and exhibits as well as shopping malls or just walking down the sidewalk. The public consumes vast amounts of carbonated beverages, ice cream or milk based drinks, ice cream, hamburgers, hot dogs, chicken on a stick, pop corn and the like while strolling. However, because of the nature of pasta dishes, it has not been practical to eat pasta products while strolling. Given the perchance of the consuming public to eat pasta and to eat while strolling, there is a need to provide a practical means of eating pasta while strolling.

It is an object of this invention to provide practical means of consuming prepared pasta dishes while strolling or otherwise away from a fixed place of eating. It is a further object to provide enclosed containers to aid consuming prepared pasta while strolling and the like. These and other objects will be readily apparent to those skilled in the art upon the reading of this specification.

SUMMARY OF THE INVENTION

In accordance with this invention there is provided in a device for serving prepared pasta products comprising in combination (1) an open ended container, (2) a removable cover for closing the open end of said container, and (3) means for removing said pasta by suction, the improvement comprising providing said suction structure communicating means with the interior of said container a pawl mechanism so positioned within said suction means as to prevent prepared pasta from returning to said container, whereby when suction is applied to the exterior end of said communicating means pasta is withdrawn from said container but when said suction is released said pasta is maintained in place by the gripping action of said pawl.

BRIEF DESCRIPTION OF THE DRAWINGS

FIG. 1 is a side view of the pasta server of this invention;

FIG. 2 is a top view of the server of FIG. 1;

FIG. 3 is a cross section side view of FIG. 1 taken along line A—A';

FIG. 4 is another pasta server of this invention; and

FIG. 5 is an alternate pawl for the pasta servers of this invention.

DESCRIPTION OF THE PREFERRED EMBODIMENT

In FIG. 1 the pasta server 10 is a cup or similar open container 11 equipped with a removable top 12. For simplicity top 12 is provided with an opening, not shown, through which the suction means which is a tube or a similar tube like structure 13 is inserted. When inserted the tube 13 communicates between the interior of the server 10 and the exterior which has been closed off by the top 12. Alternatively, top 12 and tube 13 can be a unitary structure. The pasta receiving chamber 18 is formed by container 11 and removable top 12. A satisfactory spacing of tube 13 in top 12 is illustrated in FIG. 2 wherein the tube 13 is positioned in the center of the top 12. However, if so desired, the tube 13 can be located in other portions of the top 12, e.g. off to one side.

FIG. 3 shows in cross section the pasta server of FIG. 1. Communicating tube 13 is shown going through the top 12. It is a matter of choice as to where the interior end 15 of the tube 13 is with respect to the inside bottom 16 of the container. The retaining pawl assembly 14 has pawl mechanism **14*a* fitted inside of the tube 13, preferably the pawl mechanism 14*a* will be towards the exterior end 17 of the tube 13. The pawl assembly 14 may be mounted on a friction fit pawl retainer 14*b*. Alternatively, not shown, the mechanism 14*a* may be mounted on a friction fit ring which is inserted within tube 13**.

In FIG. 4 the use of an external pawl 24 to achieve the novel results of this invention is illustrated. In this embodiment the pasta server 20 is open for filing, etc., at an end opposite the suction means or container neck 25. The open container 21 has a removable end or bottom 22. The pasta containing chamber is formed by the container 21 and bottom 22. The external pawl assembly 24 is slipped over and around container neck 25 until the assembly 24 is seated or in gripping contact with the neck 25. The assembly 24 is comprised of a combined open spout 23 and retainer **24*a* and the pawl mechanism 24*b***.

FIG. 5 shows in cross section an alternate pawl mechanism 19 for use in the pawl assembly 14, 24. The pawl assembly 19 is serrated or knurled. The serration is advantageous when the pasta is particularly lubricious due to unit weight of the pasta, nature of the sauce and the like.

Pasta is a general term which refers to all spaghetti, macaroni and noodles. It comes in over 100 shapes and sizes, some easily made at home. Spaghetti is a solid rod, available in various thicknesses as well as a wavy shape. Liniguini and fusilli are two favorite forms. Macaroni is tubular, either short or long, curved or straight; and also comes in special shapes such as shells and corkscrews. Ziti and rigatoni are among the more popular styles. Noodles are usually flat. The preferred pasta for use in this invention are the spaghetti and macaroni forms, particularly preferred is spaghetti. The suction means for pasta server 10, 20 should be appropriately sized for the pasta to be served.

The pasta, after cooking, is somewhat pliable and lubricious. One end of the cooked pasta is threaded, slipped or inserted into the suction means, e.g. spout 25 and container neck 25 or tube 13. The bulk of the pasta is placed in the pasta chamber 18 and the removable cover (top 12 or bottom 22) is affixed to close the chamber. The removable cover 12, 22 can be held to the container 11, 21 by screw threads, friction fit or the like. To the pasta can be added, as desired, any of a number of sauces traditionally associated with pasta. These sauces typically enhance the lubricious properties of the pasta.

A person eats the pasta by placing their mouth on the spout 23 or tube 13 and sucking up the pasta. When the desired amount of pasta is obtained, the person bites off the pasta and then consumes the pasta in the usual manner. When the pasta is cut the pasta in the tube 13 or spout 23 is held in place by the pawl mechanism **14*b*, 24*b*. When the person wishes more pasta the sequence is repeated. By use of the pasta server 10, 20** of this invention a person can eat pasta while strolling and the like.

The various components of the pasta server 10, 20 can be made from a variety of materials as desired. The selection of these materials and their techniques of fabrication are well known to those skilled in the art.

While not specifically shown, it is within the contemplation of this invention that the pawl assembly 24 shown in FIG. 4 can, if so desired, be substituted for the pawl assembly 14 of pasta server 10 shown in FIG. 3.

When the pawl mechanism **24*b* of FIG. 5 is comparatively long the pawl mechanism 24*b* can be flexed downward toward the spout 23 by the application of finger pressure or the like. When the pasta is in the spout 23 this flexing will move the pasta toward the free end of the spout 23 and the consumer. In such cases the pawl mechanism 24*b*** acts both as a retainer and as a feeder of, or pump for, the pasta. The consumer, thus has a choice of obtaining the pasta either by a sucking, or sipping, action or mechanically forcing the pasta to them.

The foregoing examples and methods have been described in the foregoing specifications for the purpose of illustration and not limitation. Many other modifications and ramifications will naturally suggest themselves to those skilled in the art based on this disclosure. These are intended to be comprehended as within the scope of this invention.

I claim:

1. A device for serving prepared pasta products comprising in combination (1) an open ended container, (2) a removable closure for closing the open end of said container, and (3) tubular means for removing said pasta by suction said means being attached to said removable closure, the improvement comprising providing said tubular means with a pawl mechanism so positioned within said tubular means so as to prevent prepared pasta from returning to said container, whereby when said suction is applied to the exterior end of said tubular means pasta is withdrawn from said container, but when said suction is released said pasta is maintained in place by the gripping action of said pawl.

2. The device of claim 1 wherein the tubular means is a hollow tube like. structure inserted through the removable closure which is a cover for the open container and the pawl is inside the tube like structure.

3. The device of claim of claim 2 wherein the hollow tube like structure is removable from the removable closure.

4. The device of claim 2 wherein the hollow tube like structure and removable closure is an unitary structure.

5. The device of claim 1 wherein the tubular means is a spout attached to the open throat end of the container opposite its removable bottom end and the pawl is affixed to the exterior of said spout.

6. The device of claim 1 wherein the pawl mechanism is serrated.

* * * * *